US006495761B1

(12) United States Patent
Hacker

(10) Patent No.: US 6,495,761 B1
(45) Date of Patent: Dec. 17, 2002

(54) ELECTRICAL CABLE FOR CURRENT TRANSMISSION, AND METHOD OF TRANSMITTING CURRENT THERETHROUGH

(76) Inventor: Jed Hacker, 2336 E. 26th St., Brooklyn, NY (US) 11229

( * ) Notice: Subject to any disclaimer, the term of this patent is extended or adjusted under 35 U.S.C. 154(b) by 0 days.

(21) Appl. No.: 09/709,897

(22) Filed: Nov. 13, 2000

(51) Int. Cl.[7] ..... H01B 9/02
(52) U.S. Cl. ..... 174/113 R
(58) Field of Search ..... 174/36, 113 R, 174/115, 128.1

(56) References Cited

U.S. PATENT DOCUMENTS 1,721,218 A * 7/1929 Hood ..... 174/115 X
2,623,093 A * 12/1952 Smith ..... 174/115 X
3,433,890 A * 3/1969 Gabriel et al. ..... 174/113 R X
3,742,408 A * 6/1973 Jaeger ..... 330/174
4,657,342 A * 4/1987 Baiier ..... 174/115 X
5,329,065 A * 7/1994 Marney et al. ..... 174/113 R X
5,666,452 A * 9/1997 Deitz, Sr. et al. ..... 385/100
6,297,455 B1 * 10/2001 Wijnberg et al. ..... 174/113 R

* cited by examiner

*Primary Examiner*—Chau N. Nguyen
(74) *Attorney, Agent, or Firm*—I. Zborovsky; G. Cohen

(57) ABSTRACT

An electrical cable has a plurality of bundles extending in a direction of elongation and including three bundles associated with one another, preferably so that a transverse cross-section of the cable extending transversely to a longitudinal direction is substantially triangular, the bundles having different cross-sections, so that a bundle with a smaller cross-section is adapted to transmit a higher frequency current, while a bundle with a greater cross-section is adapted to transmit current with a lower frequency signal, the bundles having one end connectable to an electrical source and another end connectable to a single electrical consumer, so as to provide a range of frequencies.

9 Claims, 2 Drawing Sheets

ELECTRICAL CABLE FOR CURRENT TRANSMISSION, AND METHOD OF TRANSMITTING CURRENT THERETHROUGH

BACKGROUND OF THE INVENTION

The present invention relates to electrical cables for transmitting current, and also to a method of transmitting current therethrough.

Electrical cables are known in many constructions and configurations. Usually electrical cables are composed of a plurality of bundles each including a number of wires, wherein the wire can include a number of strands. It is believed that the existing cables can be further improved, in particular with respect to proper cooling of the cables.

SUMMARY OF THE INVENTION

Accordingly, it is an object of the present invention to provide an electrical cable and a method of transmitting an electrical current through it, which is a further improvement of the existing cables and methods.

In keeping with these objects and with others which will become apparent hereinafter, one feature of present invention resides, briefly stated, in an electrical cable having a plurality of bundles extending in a direction of elongation and including three bundles associated with one another said bundles having different cross-sections, so that a bundle with a smaller cross-section is adapted to transmit a higher frequency current, while a bundle with a greater cross-section is adapted to transmit a current with a lower frequency current, said bundles having one end connectable to an electrical source and another end connectable to a single electrical consumer, so as to provide a range of frequencies for the same electrical consumer.

In a preferred embodiment, a transverse cross-section of the cable extending transversely to the longitudinal direction is substantially triangular.

It is also another feature of present invention to provide a method of transmitting current which includes the steps of providing an electrical cable having a plurality of bundles extending in a direction of elongation and including three bundles associated with one another so that a transverse cross-section of the cable extending transversely to the longitudinal direction is substantially triangular, said bundles having different cross-sections; and transmitting electrical current with higher frequency through a bundle with a smaller cross-section and electrical current with lower frequency through a bundle with a greater cross-section, to provide a range of frequencies for the same electrical consumer.

When the cable is designed and the method is performed in accordance with the present invention, it has been determined that the cable runs cooler and is less heated during the operation.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
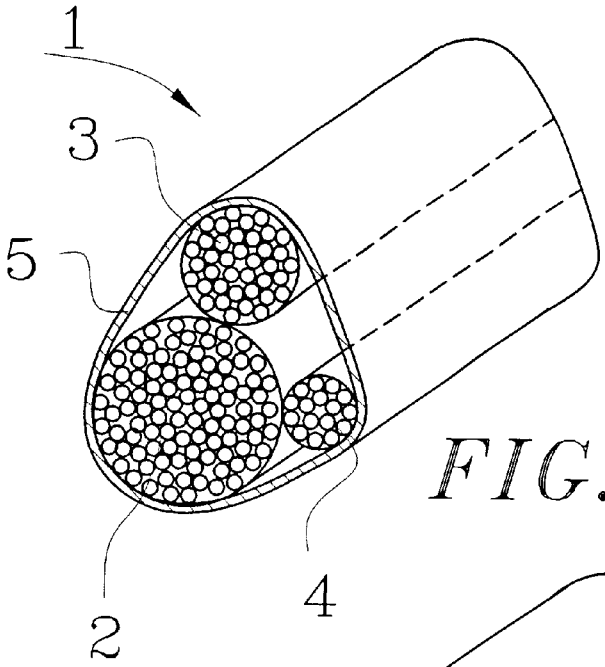
FIG. 1 is a view showing an inventive electrical cable in accordance with one embodiment of the present invention.

An electrical cable in accordance with the present invention is identified as a whole with reference numeral 1. The cable is composed of a plurality of bundles which in particular include three bundles 2, 3 and 4. As can be seen from FIG. 1, the bundles 2, 3, 4 have different cross-sections. Bundle 4 has a smaller transverse cross-section, bundle 3 has a greater transverse cross-section, and bundle 2 has the greatest transverse cross-section. As shown in FIG. 1 the bundles extend substantially parallel to one another.

A shielding element 5 surrounds the cable 1 and is composed of metal material, for example of aluminized Mylar. It provides an electrical shielding of the cable. In accordance with the present invention, a higher frequency signal is transmitted through the bundle with the smaller transverse cross-section, while a lower frequency current is transmitted through bundle with a greater cross-section. Thus, currents with correspondingly smaller, greater and greatest frequencies are transmitted through the bundles 3, 4, 2 correspondingly. One end of each bundle is connected with sources of current, while the other end of each bundle is connected with a small current consumer.

Figure 2:
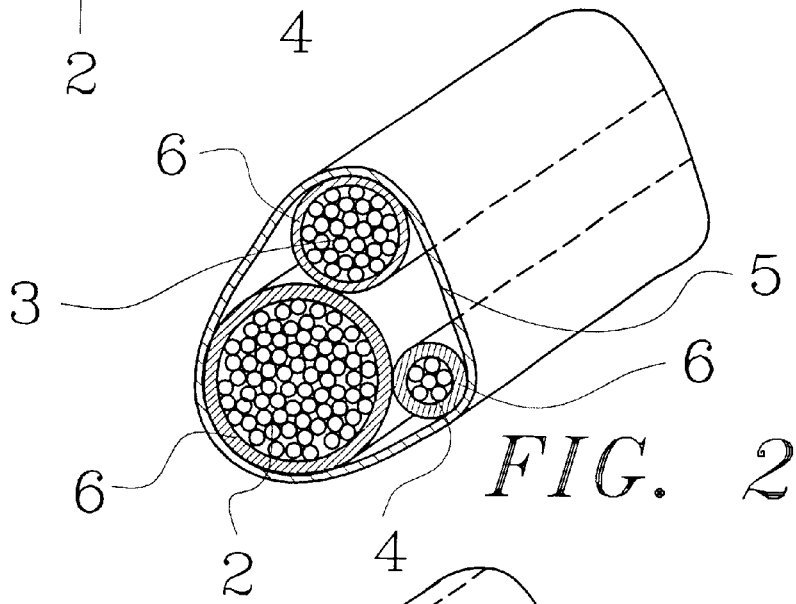
FIG. 2 is a view showing an electrical cable in accordance with another embodiment of the present invention.
Figure 3:
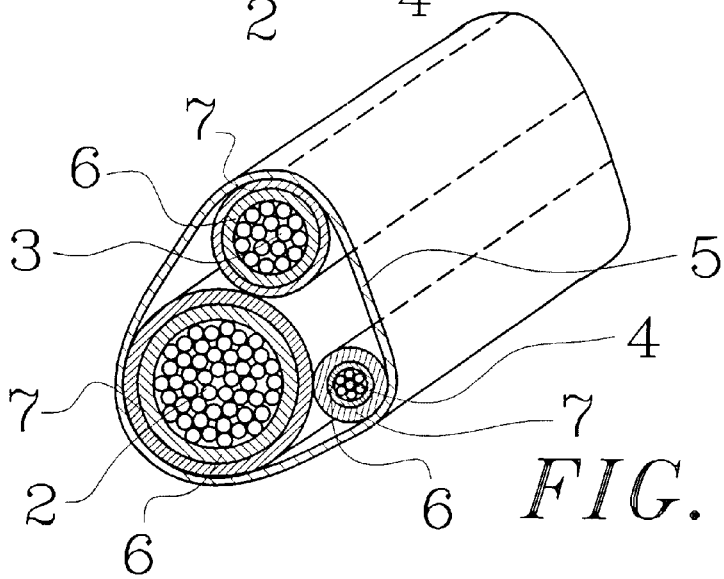
FIG. 3 is a view showing an electrical cable in accordance with a further embodiment of the present invention.
Figure 4:
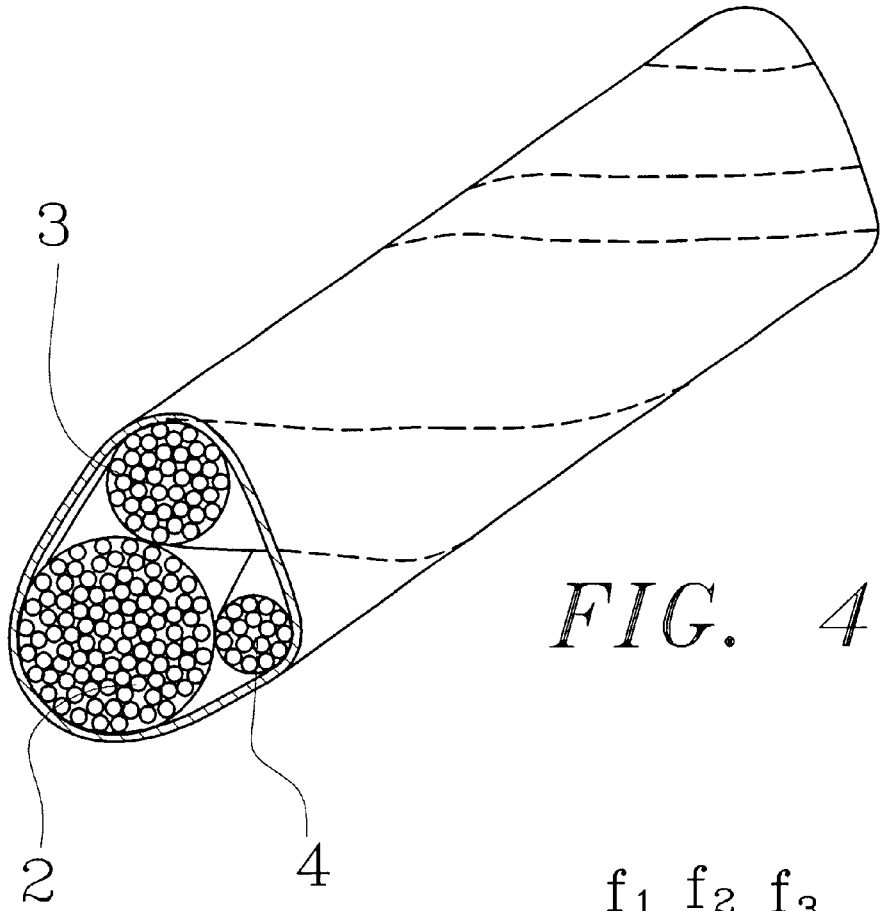
FIG. 4 is a view showing an electrical cable in accordance with still a further embodiment of the present invention.

In the embodiment of FIG. 2, each bundle 2, 3, 4 is provided with a jacket 6 for insulation purposes. The jacket 6 is composed of an insulating material, such as polyvinyl chloride, polyethylene, or Teflon. In the embodiment of FIG. 3, each bundle 2, 3, 4 of the cable has the jacket 6 and in addition a shielding member 7 surrounding the jacket 6 and provided for electrical shielding of each bundle. In accordance with the invention, the parallel bundles 2, 3, 4 of the cable can be twisted with one another as shown in FIG. 4. It is possible to have three-twelve twists per one foot of the length of the cable, and preferably six twists.

Figure 5:
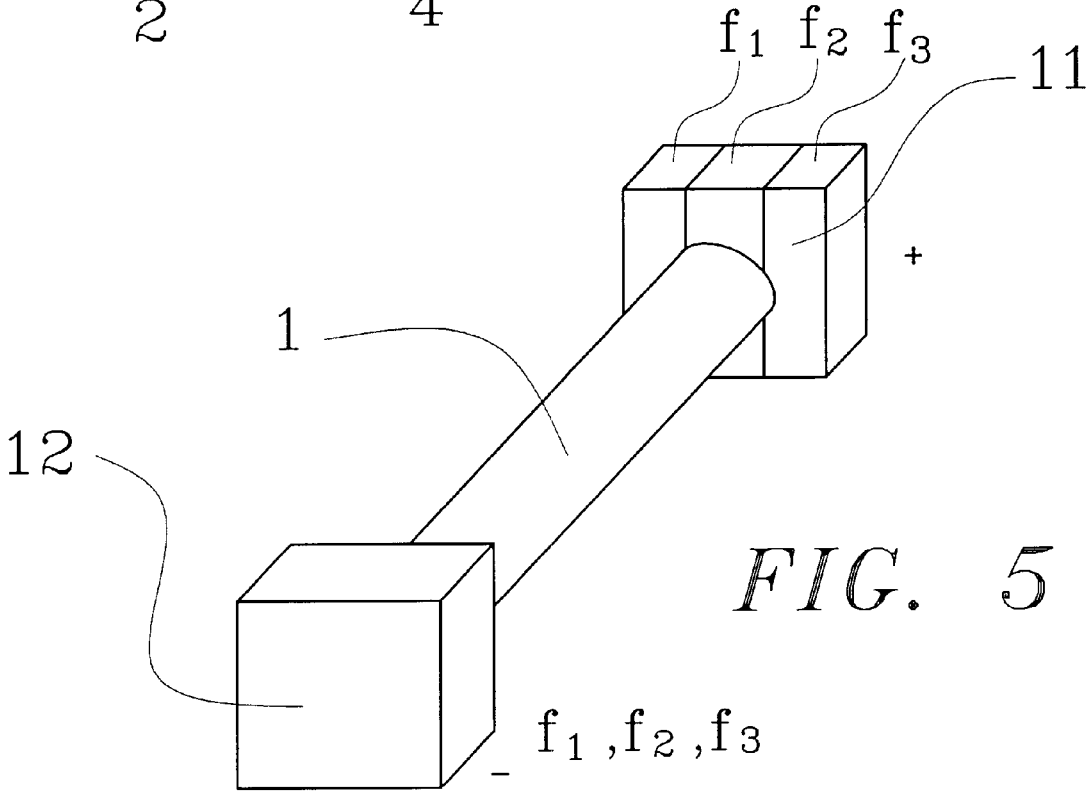
FIG. 5 is a view showing an electrical device which utilizes the inventive electrical cable.

FIG. 5 shows an electrical device which includes an electrical cable 1 extending between a source of electrical current 11 which is a negative pole and provides currents with 3 different frequencies, to a consumer of electrical current which is a positive pole. In accordance with the present invention, one end of the electrical cable 1 is connected to the electrical source 1, while the other end of the electrical cable 1 is connected to the same electrical consumer 12 so that each bundle 2, 3, 4, is connected to the same electrical consumer, in contrast to non cables in which different bundles are connected with different consumers. In the present invention the currents of different frequencies transmitted through the bundles 2, 3, 4, are supplied to the same consumer, for example to a speaker of an electrical musical instrument so as to provide a range between for example 5 Hz and 20 kHz for the same consumer or musical instrument.

It will be understood that each of the elements described above, or two or more together, may also find a useful application in other types of constructions differing from the types described above.

While the invention has been illustrated and described as embodied in an electrical cable for current transmission, and method of transmitting current therethrough, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. An electrical cable, comprising a plurality of bundles extending in a direction of elongation said plurality of bundles comprising three bundles associated with one another and each composed of a plurality of wires, said bundles having different cross-sections, so that one of said bundles with a smaller cross-section transmits a high frequency current, while another of said bundles with a greater cross-section transmits a current with a low frequency said bundles having one end connectable to an electrical source providing different frequencies and another end connectable to a single electrical consumer, so as to provide a range of frequencies for the single electrical consumer; and a shielding member for electrically shielding the cable, said shielding member being composed of a plurality of shields each surrounding one of said bundles.

2. An electrical cable as defined in claim 1, wherein said bundles extend substantially parallel to one another.

3. An electrical cable as defined in claim 2, wherein said bundles are twisted with one another.

4. An electrical cable as defined in claim 3, wherein said bundles are twisted with one another so as to form between three and twelve twists per foot of an elongation of the cable.

5. An electrical cable as defined in claim 1, and further comprising a jacket surrounding each of said bundles for insulation purposes.

6. An electrical cable as defined in claim 5, wherein said jacket is composed of a material selected from the group consisting of polyvinylchloride, polyethylene, and Teflon.

7. An electrical cable as defined in claim 1, and further comprising an additional shielding member which surrounds each of said bundles covered with said shielding members.

8. An electrical cable as defined in claim 1, wherein said shielding member is composed of a metalized material.

9. An electrical cable as defined in claim 8, wherein said shielding member is composed of aluminized Mylar.

* * * * *